US006898402B2

(12) United States Patent
Kim

(10) Patent No.: US 6,898,402 B2
(45) Date of Patent: May 24, 2005

(54) DEVELOPING UNIT AND ELECTROPHOTOGRAPHIC IMAGE FORMING APPARATUS USING THE SAME

(75) Inventor: Kyung-hwan Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/602,665

(22) Filed: Jun. 25, 2003

(65) Prior Publication Data

US 2004/0096240 A1 May 20, 2004

(30) Foreign Application Priority Data

Jun. 25, 2002 (KR) ..... 10-2002-0035670
Mar. 5, 2003 (KR) ..... 10-2003-0013613

(51) Int. Cl.[7] ..... G03G 15/06
(52) U.S. Cl. ..... 399/222
(58) Field of Search ..... 399/107, 119, 399/222, 223, 226, 228, 167

(56) References Cited

U.S. PATENT DOCUMENTS 5,528,343 A * 6/1996 Tada et al. ..... 399/113
5,749,031 A * 5/1998 Miwa et al. ..... 399/228
6,704,529 B2 * 3/2004 Noh ..... 399/167

FOREIGN PATENT DOCUMENTS

| | | |
|---|---|---|
| JP | 2275970 | 11/1990 |
| JP | 8110710 | 4/1996 |
| JP | 8331951 | 12/1996 |
| JP | 10186775 | 7/1998 |

* cited by examiner

*Primary Examiner*—Hoan Tran
(74) *Attorney, Agent, or Firm*—Staas & Halsey, LLP

(57) ABSTRACT

A developing unit of an electrophotographic image forming apparatus includes at least one developing apparatus installed to be capable of accessing and being separated with respect to a photoreceptive drum and including a developing roller developing an electrostatic latent image formed on the photoreceptive drum and a gap maintenance member closely contacting the photoreceptive drum such that the developing roller accesses the photoreceptive drum in a non-contact state while maintaining a predetermined gap with the photoreceptive drum, and a guide portion formed on a frame to guide a movement of the developing apparatus. An inclined portion facing a center shaft of the photoreceptive drum is provided at a leading end of the guide portion so that the gap maintenance member closely contacts the photoreceptive drum while pressing the photoreceptive drum in a radial direction of the photoreceptive drum.

46 Claims, 6 Drawing Sheets

DEVELOPING UNIT AND ELECTROPHOTOGRAPHIC IMAGE FORMING APPARATUS USING THE SAME

CROSS-REFERENCE TO RELATED APPLICATIONS

This application claims the priority of Korean Patent Application Nos. 2002-35670 filed on Jun. 25, 2002, and 2003-13613 filed on Mar. 5, 2003, in the Korean Intellectual Property Office, the disclosures of which are incorporated herein in entirety by reference.

BACKGROUND OF THE INVENTION

1. Field of the Invention

The present invention relates to a developing unit, and an electrophotographic image forming apparatus including the developing unit.

2. Description of the Related Art

For example, in the conventional electrophotographic image forming apparatus, such as a dry type color laser printer, an electrostatic latent image is formed on a photosensitive medium, and the electrostatic latent image is developed with toner powder. The developed image is transferred to a sheet of print paper via a predetermined transfer mechanism. The conventional electrophotographic image forming apparatus is disclosed in Japanese Patent Publication No. Hei 8-334951, Japanese Patent Publication No. Hei 8-110710, Japanese Patent Publication No. Hei 2-275970, and Japanese Patent Publication No. Hei 10-186775.

FIG. 1 shows an example of a typical electrophotographic image forming apparatus. Referring to FIG. 1, the image forming apparatus includes a photoreceptive drum 10 which is a photosensitive medium, a charging unit 11 charging the photoreceptive drum 10; a laser scanning unit (LSU) 12 which is an exposing unit scanning light onto the charged photoreceptive drum 10 to form an electrostatic latent image, a developing unit 13 developing the electrostatic latent image using toners of four colors, that is, yellow (Y), magenta (M), cyan (C), and black (K), a transfer unit including a transfer belt 14 sequentially receiving four-color images developed on the photoreceptive drum 10 to overlap one another to produce a desired color image and transfer the color image on a sheet of paper, and a fusing unit 15 fixing the transferred color image by pressing and heating the paper. Four developing apparatuses Y, M, C, K (13-Y, 13-M, 13-C, and 13-K) provided in the developing unit 13 are all elastically biased by a predetermined spring (not shown) in a direction separated from the photoreceptive drum 10. When the developing apparatuses Y, M, C, K (13-Y, 13-M, 13-C, and 13-K) are selectively moved toward the photoreceptive drum 10 according to a rotation of a cam 13*b*, a developing roller 13*a* located at a leading end of each developing apparatus Y, M, C, K (13-Y, 13-M, 13-C, and 13-K) accesses the photoreceptive drum 10. The image forming apparatus further includes a paper cassette 16, a photoreceptive drum cleaning unit 17, and a discharging unit 18.

In the image forming apparatus having the above structure, an image forming process is performed as follows. First, when the photoreceptive drum 10 is charged by the charging unit 11, the LSU 12 scans the light to form the electrostatic latent image to be developed with first color toner. For example, when a yellow color is to be developed first, the yellow color developing apparatus 13-Y accesses the photoreceptive drum 10 and develops the electrostatic latent image formed on the photoreceptive drum 10 with yellow color toner. The developed yellow image is transferred to the transfer belt 14. Next, another electrostatic latent image for a second color is formed by charging and exposing of the photoreceptive drum 10. If the second color is magenta, the magenta color developing apparatus 13-M accesses the photoreceptive drum 10 and develops the another electrostatic latent image formed on the photoreceptive drum 10 with magenta color toner, and the developed magenta image is transferred to the transfer belt 14 where the yellow image is already transferred, to overlap the yellow image. Images of cyan, a third color, and black, a fourth color, are developed and transferred to the transfer belt 14 in the same manner so that the color image of a desired color is finally formed on the transfer belt 14. Then, the completed color image is transferred to the paper supplied between the transfer belt 14 and a transfer backup roller 14*a*. As passing through the fusing unit 15, the color image is completely fixed to the paper by being heated and pressed.

Here, the respective developing apparatuses Y, M, C, K (13-Y, 13-M, 13-C, and 13-K) of the developing unit 13 have a structure shown in FIG. 2. FIG. 2 shows the black developing apparatus 13-K of the four color developing apparatuses Y, M, C, K (13-Y, 13-M, 13-C, and 13-K) as an example. As shown in FIG. 2, the black developing apparatus 13-K includes a main body 13*d* slidably supported by a guide slot 19*a* of a frame 19, a developing roller 13*a* supplying toner contained in the main body 13*d* to a surface of the photoreceptive drum 10 having a gap g with the developing roller 13*a* to attach the toner to the surface of the photoreceptive drum 10, and a gap maintenance roller 13*c* installed coaxially with the developing roller 13*a* to maintain the development gap g. Thus, when the main body 13*d* of the developing apparatus is driven by a cam 13*b* to access the photoreceptive drum 10, the gap maintenance roller 13*c* contacts the photoreceptive drum 10 to form the development gap g. In this state, the toner adhering to the developing roller 13*a* is transferred to the photoreceptive drum 10 where the electrostatic latent image is formed, via the developing gap g by a difference in electrical potential.

However, in the above structure, since the four color developing apparatuses Y, M, C, K (13-Y, 13-M, 13-C, and 13-K) alternately access the photoreceptive drum 10 and retreat therefrom to form the color image, an impact generated by the gap maintenance roller 13*c* colliding against the photoreceptive drum 10 is continuously generated. Then, an error can be generated in the developed image formed on the photoreceptive drum 10. Thus, as shown in FIG. 3, a method has recently been suggested, in which the four developing apparatuses 13-Y, 13-M, 13-C, and 13-K are elastically biased by a spring 20, so that they can be fixedly disposed close to the photoreceptive drum 10, and the development process performed by a developing apparatus to obtain the desired color image can be selected by adjusting the difference in the electrical potential between the respective developing apparatuses 13-Y, 13-M, 13-C, and 13-K and the photoreceptive drum 10.

However, in the above methods in which the respective developing apparatuses 13-Y, 13-M, 13-C, and 13-K alternately accesses the photoreceptive drum 10 for development as shown in FIG. 1, and in which the gap maintenance rollers 13*c* of the respective developing apparatuses 13-Y, 13-M, 13-C, and 13-K closely contacts the photoreceptive drum 10 for development as shown in FIG. 3, a direction A in which the developing apparatuses 13-Y, 13-M, 13-C, and 13-K move simultaneously, includes a component (normal direction of a surface of the photoreceptive drum 10) G variable according to the development gap g and components (tangential or alignment directions of the surface of the photoreceptive drum 10) B, C, D, and E variable according to an alignment between the developing roller 13*a* and the photoreceptive drum 10. That is, as the gap maintenance roller 13*c* moves in the direction A, displacements are simultaneously generated in the development gap g in the normal direction G and the alignment directions B, C, D, and E. Here, the displacement in each of the alignment directions B, C, D, and E matters. The displacement in each of the alignment directions B, C, D, and E indicates an unbalanced state between a center axis of the development roller 13*a* and an axis of the photoreceptive drum 10. In this case, even when the gap maintenance roller 13*c* accurately contacts the photoreceptive drum 10, the development gap g is changed at both ends of the developing roller 13*a* and the center of the photoreceptive drum 10 so that an image having uniform concentration cannot be obtained. The above defect results from inconsistency between the direction A, in which the gap maintenance roller 13*c* moves, and the normal direction G of the development gap g. Therefore, a development unit having an improved structure to solve the above problem is needed.

SUMMARY OF THE INVENTION

To solve the above and/or other problems, the present invention provides a developing unit which stably maintains a relative position between a photoreceptive drum and a developing roller, and an electrophotographic image forming apparatus adopting the same.

Additional aspects and advantages of the invention will be set forth in part in the description which follows and, in part, will be obvious from the description, or may be learned by practice of the invention.

According to an aspect of the present invention, a developing unit of an electrophotographic image forming apparatus includes at least one developing apparatus installed to access and be separated from a photoreceptive drum, and a guide portion. The developing apparatus of the presenting invention includes a developing roller developing an electrostatic latent image formed on the photoreceptive drum and a gap maintenance member closely contacting the photoreceptive drum such that the developing roller accesses the photoreceptive drum in a non-contact state while maintaining a predetermined gap with the photoreceptive drum. The guide portion is formed on a frame to guide a movement of the developing apparatus. An inclined portion facing a center shaft of the photoreceptive drum is positioned at a leading end of the guide portion so that the gap maintenance member closely contacts the photoreceptive drum while pressing the photoreceptive drum in a radial direction of the photoreceptive drum.

According to another aspect of the present invention, an electrophotographic image forming apparatus includes a charger charging a photoreceptive drum, an exposing unit exposing the charged photoreceptive drum to form an electrostatic latent image, a developing unit developing the electrostatic latent image with toner of a predetermined color, and a transfer unit transferring the developed image to a sheet of paper. The developing unit includes at least one developing apparatus installed to access and be separated from a photoreceptive drum. The developing unit includes a developing roller developing the electrostatic latent image formed on the photoreceptive drum and a gap maintenance member closely contacting the photoreceptive drum such that the developing roller accesses the photoreceptive drum in a non contact state while maintaining a predetermined gap with the photoreceptive drum, and a guide portion formed on a frame to guide a movement of the developing apparatus. An inclined portion facing a center shaft of the photoreceptive drum is located at a leading end of the guide portion so that the gap maintenance member closely contacts the photoreceptive drum while pressing the photoreceptive drum in a radial direction of the photoreceptive drum.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
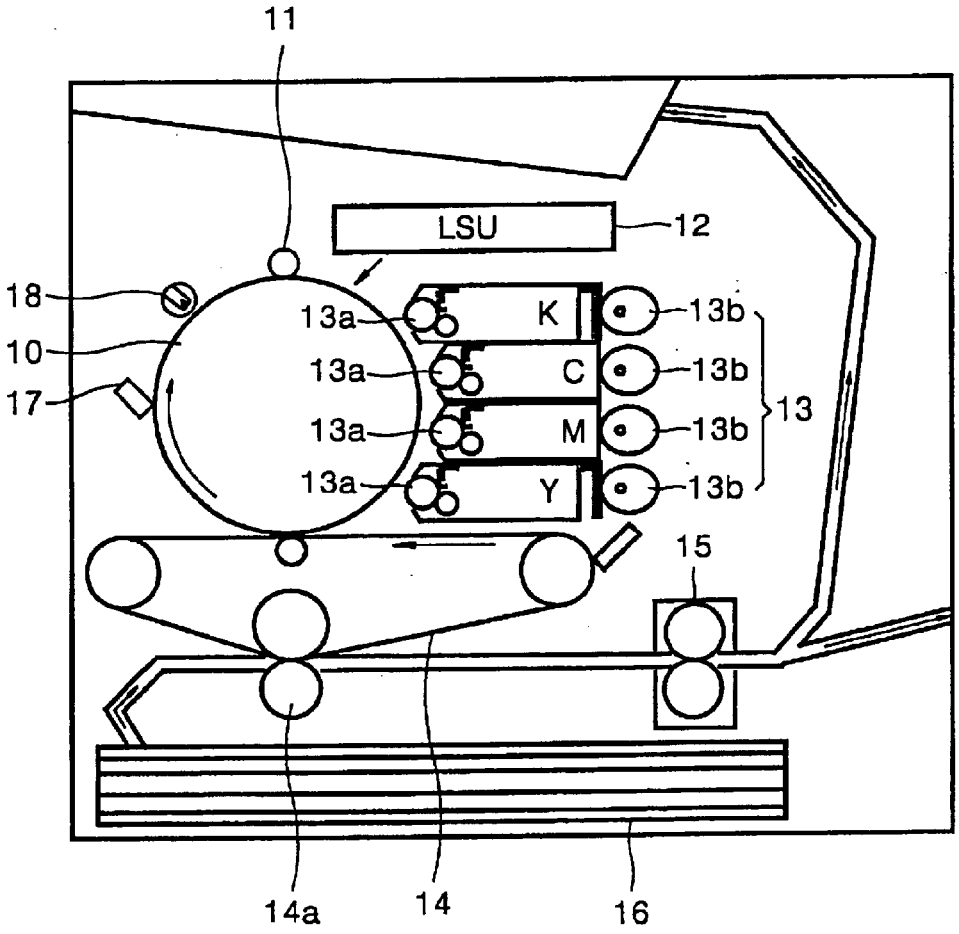
FIG. 1 (PRIOR ART)
FIG. 1 is a view illustrating an image forming apparatus adopting a conventional developing unit.
Figure 2:
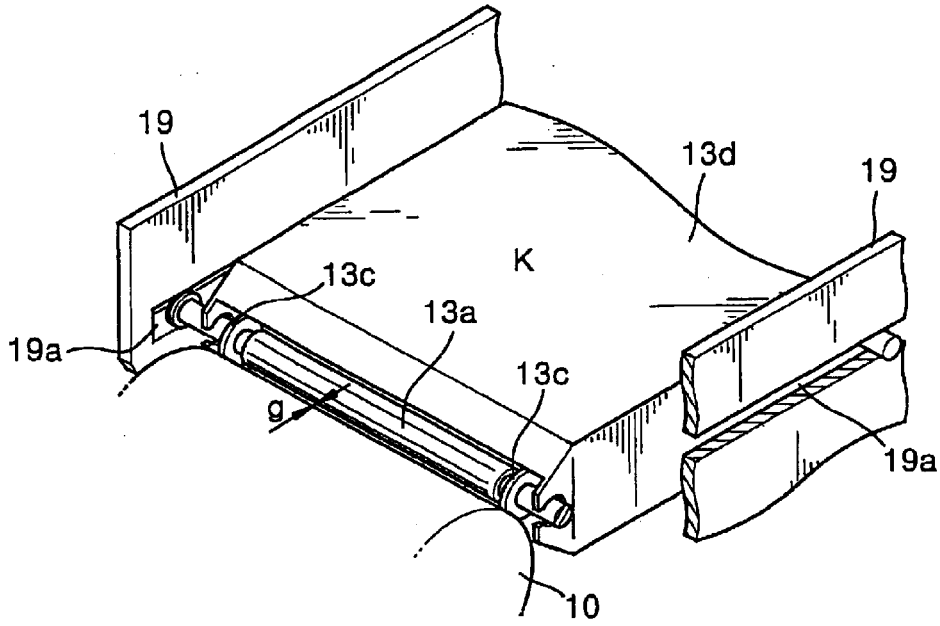
FIG. 2 (PRIOR ART)
FIG. 2 is a perspective view illustrating the conventional developing unit of FIG. 1.
Figure 3:
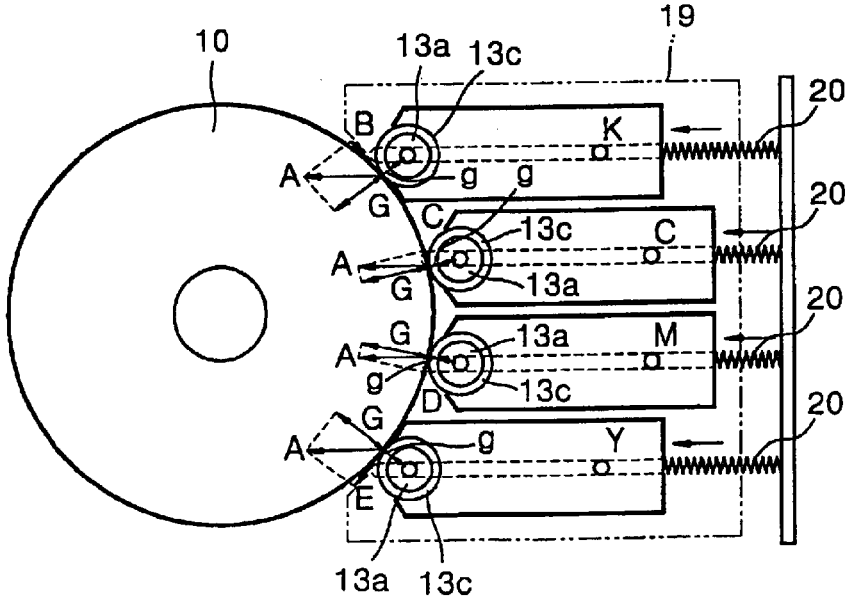
FIG. 3 (PRIOR ART)
FIG. 3 is a view illustrating another example of the conventional developing unit of the image forming apparatus of FIG. 1.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 4:
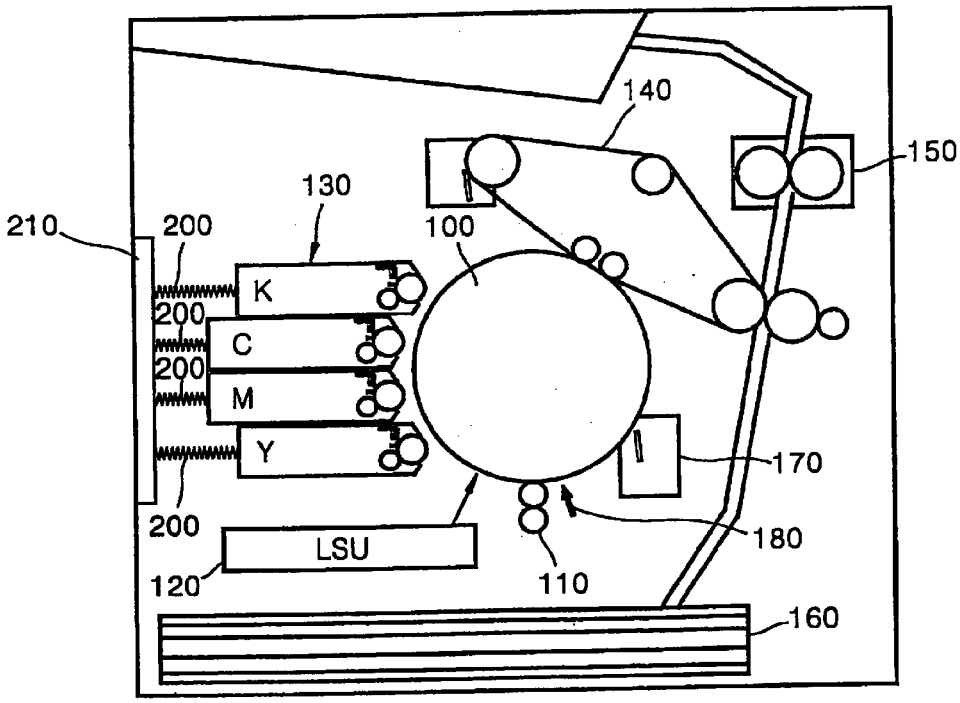
FIG. 4 is a view illustrating a structure of an image forming apparatus adopting a developing unit according to an embodiment of the present invention.

Referring to FIG. 4, an electrophotographic image forming apparatus comprising a developing unit according to an embodiment of the present invention includes a photoreceptive drum 100 which is a photosensitive medium, a charging unit 110 charging the photoreceptive drum 100, a laser scanning unit (LSU) 120 which is an exposing unit forming an electrostatic latent image of a desired image by scanning light onto the charged photoreceptive drum 100, a developing unit 130 developing the electrostatic latent image with powder toner of four colors of yellow (Y), magenta (M), cyan (C), and black (K), a transfer unit 140 receiving images in the four colors developed on the photoreceptive drum 100 in order to overlap one another and transferring the overlapped images to a sheet of print paper, and a fusing unit 150 fixing the transferred image on the print paper by pressing and heating the print paper. The electrophotographic image forming apparatus further includes a paper cassette 160, a photoreceptive drum cleaning unit 170, and a discharging unit 180.

Figure 5:
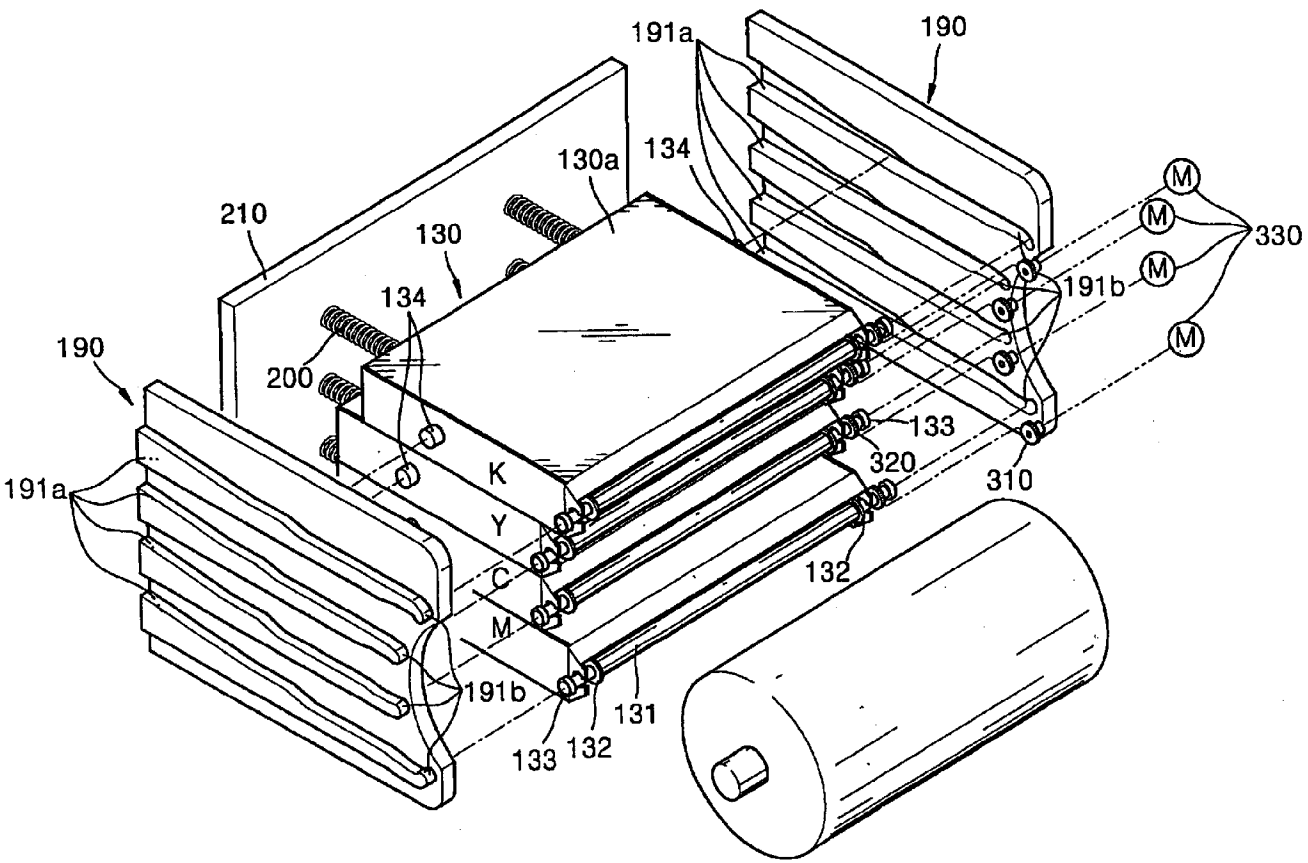
FIG. 5 is a perspective view of the developing unit shown in FIG. 4.

Here, each of four-color developing units 130-M, 130-C, 130-Y, and 130-K included in the developing unit 130 as shown in FIG. 5, includes a developing unit main body 130*a* slidably supported by a guide portion 191 of a frame 190, a developing roller 131 supplying the toner contained in the developing unit main body 130*a* to an outer circumferential surface of the photoreceptive drum 100 in a non-contact state to attach the toner to the developing roller 131, and a gap maintenance roller 132 installed to be coaxial with the developing roller 131 and closely contacting the photoreceptive drum 100 to maintain a predetermined development gap between the photoreceptive drum 100 and the developing roller 131. The developing unit main body 130*a* is elastically biased by a spring 200 in a direction in which the developing unit main body 130*a* accesses the photoreceptive drum 100 along the guide portion 191, that is, the gap maintenance roller 132 closely contacts the photoreceptive drum 100. The spring 200 is typically installed at an opening/closing door 210 of the image forming apparatus so that, when the door 210 is closed, the developing unit main body 130*a* is pushed toward the photoreceptive drum 100. The developing roller 131 is rotated by a predetermined developing roller driving mechanism which will be described later.

A feature of the developing unit having the guide portion 191 will be described hereinafter. That is, a guide boss 134 provided at the developing unit main body 130*a* and a bearing member 133 rotatably supporting a rotation shaft of the developing roller 131 are slidably inserted in the guide portion 191. The guide portion 191 includes a linear portion 191*a* formed to be extended in a horizontal direction and an inclined portion 191*b* formed to be inclined with respect to the horizontal direction toward a center shaft 101 of the photoreceptive drum 100. The linear portion 191*a* guides a horizontal movement of the guide boss 134. The inclined portion 191*b* guides a movement of the bearing member 133 of the rotation shaft of the developing roller 131, which is disposed at a leading end of the main body 130*a*, in a radial direction of the photoreceptive drum 100. Thus, the bearing member 133 rotatably supports the rotation shaft of the developing roller 131 and is simultaneously restricted to move only in the radial direction of the photoreceptive drum 100 along the inclined portion 191*b*.

Figure 6:
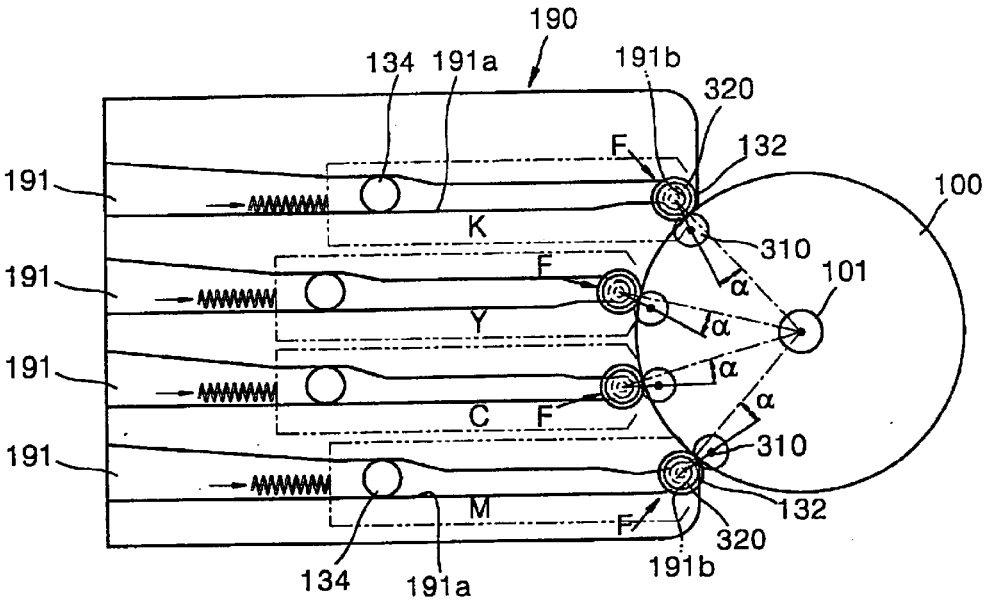
FIG. 6 is a view showing a relationship among a developing apparatus guide portion, a developing roller driving mechanism, and a photoreceptive drum in the developing unit shown in FIG. 4.

Since the gap maintenance roller 132 is installed coaxial with the bearing member 133, the gap maintenance roller 132 moves in the radial direction of the photoreceptive drum 100, that is, in a direction toward the center shaft 101 of the photoreceptive drum 100, and closely contacts the photoreceptive drum 100 as shown in FIG. 6. Consequently, the developing roller 131 moved by the bearing member 133 moves only in the axial direction with respect to the photoreceptive drum 100, and an alignment between the developing roller 131 and the photoreceptive drum 100 is not changed although the development gap is changed. That is, a pressure F applied to the photoreceptive drum 100 as the gap maintenance roller 132 closely contacts the photoreceptive drum 100, acts only in the radial direction of the photoreceptive drum 100 as shown in FIG. 6. Then, since the pressure F of the gap maintenance roller 132 does not act in the tangential direction of the photoreceptive drum 100, there is no possibility of the gap maintenance roller 132 slipping along the photoreceptive drum 100 in the tangential direction. Accordingly, a position of the developing apparatus main body 130*a* is not changed with respect to the photoreceptive drum 100, and the alignment between the developing roller 131 and the photoreceptive drum 100 is not changed. Thus, development of the images can be stably performed.

Next, in the developing roller driving mechanism rotating the developing roller 131 as shown in FIGS. 5 and 6, a gear 320 (hereinafter, referred to as a second gear) receiving a rotation power is provided between the bearing member 133 and the gap maintenance roller 132 of the rotation shaft of the developing roller 131. Another gear 310 (hereinafter, referred to as a first gear) rotated by a motor 330 is inlcuded. The first gear 310 is coupled to the second gear 320 as the developing apparatus main body 130*a* accesses the photoreceptive drum 100 by the spring 200 so that the gap maintenance roller 132 closely contacts the photoreceptive drum 100. Thus, when the gap maintenance roller 132 closely contacts the photoreceptive drum 100 so that the development gap is formed between the developing roller 131 and the photoreceptive drum 100, the first and second gears 310 and 320 are engaged with each other, and then the developing roller 131 is rotated by the motor 330 through the first and second gears 310, 320.

Here, it is possible that a first center shaft of the first gear 310 is disposed to be deviated from a line connecting a second center shaft of the second gear 320 and the center shaft 101 of the photoreceptive drum 100 by a predetermined gear pressure angle $\alpha$ to maintain the developing gap stably. That is, assuming that a line connecting the first and second center shafts of the first and second gears 310 and 320 is a first line, and that the line connecting the second center shaft of the second gear 320 and the center shaft 101 of the photoreceptive drum 100 is a second line, the first and second lines are arranged to form an acute angle corresponding to the gear pressure angel $\alpha$. Although varying according to a gear hob used during gear processing, the gear pressure angle $\alpha$ may be 20° or 15° in some cases. A direction in which the first line of the first center shaft of the first gear 310 is deviated from the second line is determined to be different according to positions and rotation directions of the first and second gears 310 and 320.

When the first gear 310 that is a driving portion is located at a right side of the second gear 320, and a rotation direction of the first gear 310 is clockwise as shown in FIG. 6, the center shaft of the first gear 310 is deviated from the second line in a clockwise direction with respect to the second gear 320 that is a driven portion. In the above structure, when the second gear 320 provided on the rotation shaft of the developing roller 131 is rotated by receiving the rotation power from the first gear 310, since a direction P (refer to FIG. 7) of the gear pressure transferred to the second gear 320 is in a direction perpendicular to the inclined portion 191*b* of the guide portion 191, the pressure F by the first gear 310 is all absorbed by a wall portion of the guide portion 191, and no force is generated in a guide direction of the guide portion 191 that affects the development gap. Thus, the development gap can be stably maintained.

Figure 7:
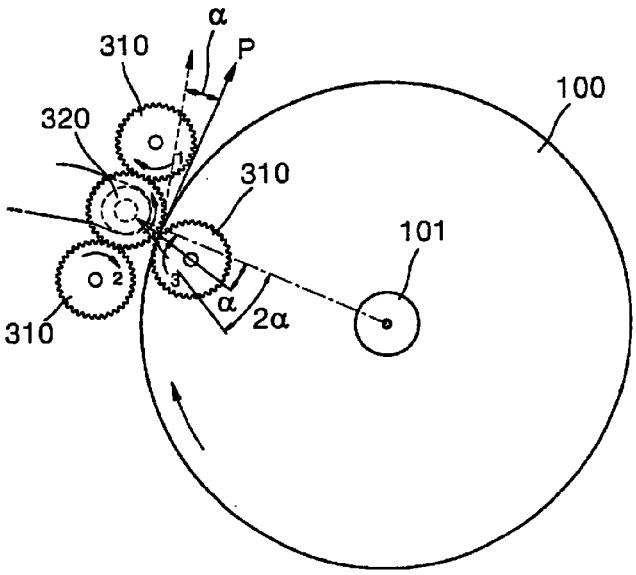
FIGS. 7 and 8 are views illustrating an arrangement of a first gear connected to a motor in the developing roller driving mechanism of the developing unit shown in FIGS. 4 and 6.

To review a stability of the development gap according to a position of the first gear 310, tests have been performed as shown in FIG. 7. That is, the first gear 310 is disposed at the position deviated by the gear pressure angle $\alpha$ from the second line connecting the second center shaft of the second gear 320 and the center shaft 101 of the photoreceptive drum 100 (a third case). Also, the first gear 310 is arranged at an upper side of the second gear 320 (a first case) and a lower side of the second gear 320 (a second case) perpendicularly with respect to the above second line. In these cases, a repulsive force applied to a driven side opposite to a driving side where the developing roller driving mechanism of the developing apparatus is present, that is, a force pushed in a direction in which the developing apparatus main body 130*a* is separated from the photoreceptive drum 100, is measured.

In other words, a force to be added to the driving side and the driven side to continuously maintain the same development gap is measured. Test results are shown in Table 1.

TABLE 1

| | Driving Side (kgf) | Driven Side (kgf) |
|---|---|---|
| First Case (Upper Side) | 6.5 or more | 2–2.5 |
| Second Case (Lower Side) | 0 | 3–3.5 |
| Third Case | 0.8–1 | 0.7–1.2 |

In the first case, as shown in FIG. 7, the gear pressure by the first gear 310 transferred to the second gear 320 acts in a direction in which the second gear 320 is pushed separated from the photoreceptive drum 100. Then, the repulsive force at the driving side where the developing roller driving mechanism is greater than that at the driven side. According to the result shown in Table 1, the repulsive force at the driving side is approximately three times greater than that at the driven side. Since the repulsive force at the driving side becomes greater, the development gap at the driving side increases so that concentration of the image is lowered or development of the image is not performed at all, thus easily causing white void. To solve the above problem, the pressure F at the driving side is increased.

In the second case, the gear pressure by the first gear 310 transferred to the second gear 320 acts in a direction in which the second gear 320 is pushed toward the photoreceptive drum 100. In this case, the test results show that the repulsive force at the driven side is similar to that of the first case, but the repulsive force at the driving side is substantially none. This is because the gear pressure transferred to the second gear 320 mostly acts in a direction to press the photoreceptive drum 100. Then, since the pressure F applied to the photoreceptive drum 100 becomes too great, the development gap at the driving side is overly narrowed so that the image is developed thick or a load increases in the photoreceptive drum 100.

In the third case which is suggested by the present invention, the driving side and the driven side have a small amount of the repulsive force and there hardly is a deviation between both driving and driven sides. Here, since the gear pressure transferred from the first gear 310 to the second gear 320 acts in a direction P which is perpendicular to a direction in which the second gear 320 closely contacts the photoreceptive drum 100, the second gear 320 is hardly moved toward the photoreceptive drum 100 or in a reverse direction due to the gear pressure. Thus, when the first gear 310 is arranged to be disposed at a position moved by the gear pressure angle $\alpha$ clockwise from the second line connecting the second center shaft of the second gear 320 and the center shaft 101 of the photoreceptive drum 100, a phenomenon that the development gap is changed by a transfer of the gear pressure can be prevented.

Therefore, since the developing roller 131 and the bearing portion installed on the rotation shaft of the gap maintenance roller 132 move along the inclined portion 191*b* formed in the radial direction of the photoreceptive drum 100, the gap maintenance roller 132 is prevented from moving in the tangential direction of the photoreceptive drum 100. Also, in a power transfer structure to drive the developing roller 131, by disposing the first gear 310 as described above, a change in the development gap according to the transfer of the gear pressure can be prevented.

Figure 8:
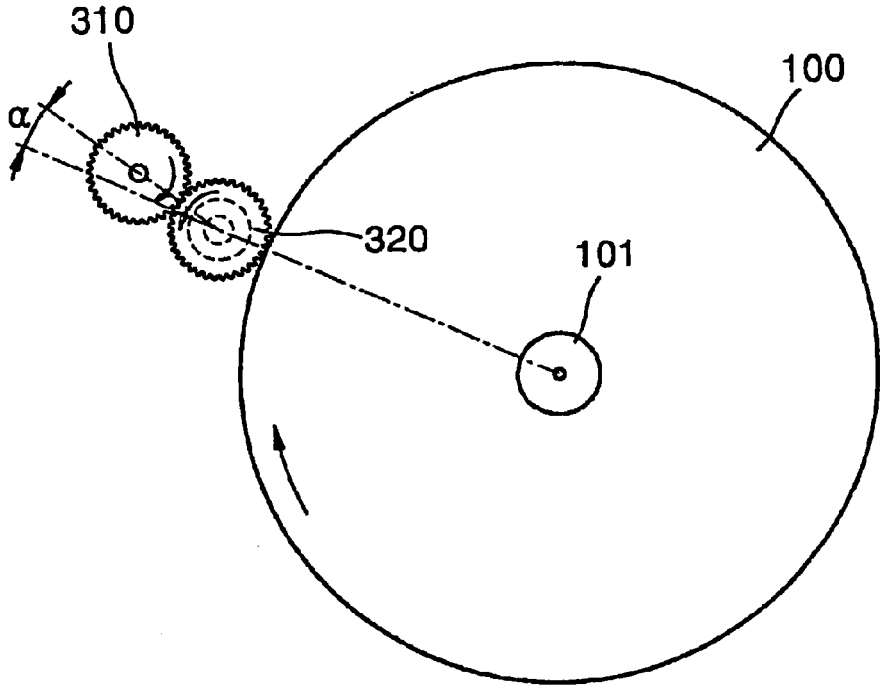

When the first gear 310 is arranged at a position opposite by 180° to the position in the third case of FIG. 7 as in FIG. 8, the same effect is obtained. In this case, however, since a path that the developing unit main body 130*a* enters along the guide portion 191 interferes with the position of the first gear 310, the first gear 310 is configured to be movable such that the first gear 310 is moved and engaged with the second gear 320 after the developing unit main body 130*a* has entered toward the photoreceptive drum 100.

In the meantime, in the present invention, a developing unit performing development in a state in which all the respective gap maintenance rollers 132 of the four developing apparatuses 130-M, 130-C, 130-Y, and 130-K closely contact the photoreceptive drum 100 is described. However, it is possible to adopt the above developing unit in the structure in which each of the four developing apparatuses alternately accesses or retreats from the photoreceptive drum 100 one by one as shown in FIG. 1. In this case, since the gap maintenance roller 132 closely contacts the photoreceptive drum 100 to be directed to move toward the center shaft 101 of the photoreceptive drum 100, the deviation in the tangential direction can be prevented.

The above effect is obtained not only when the first gear 310 is disposed in the above-described position, but also when the first gear 310 is disposed at a position within a range from at an angle of 0° clockwise to $2\alpha$ which is two times greater than the gear pressure angle $\alpha$ as shown in FIGS. 7 and 8, that is, a change in the development gap due to the gear pressure can be effectively prevented compared to the upper side and lower side positions of the second gear 320 in the first and second cases.

As described above, the developing unit of the electrophotographic image forming apparatus according to the present invention has the following effects.

First, since the direction in which the gap maintenance roller closely contacts the photoreceptive drum is set to be in the radial direction of the photoreceptive drum, the gap maintenance roller is prevented from moving in the tangential direction at a contact point with the photoreceptive drum so that the development gap can be stably maintained.

Second, in the power transfer structure to drive the developing roller, since the first gear is rotatably installed at a position deviated by the gear pressure angle from the second center line connecting the developing roller and the photoreceptive drum with respect to the developing roller, a change in the development gap due to the transfer of the gear pressure can be restricted.

Although an embodiment of the present invention has been shown and described, it would be appreciated by those skilled in the art that changes may be made in this embodiment without departing from the principles and sprit of the invention, the scope of which is defined in the claims and their equivalents.

What is claimed is:

1. A developing unit of an electrophotographic image forming apparatus including a frame and a photoreceptive drum having a center shaft, comprising:

at least one developing apparatus installed on the frame to access and be separated from the photoreceptive drum, and including:

a developing roller developing an electrostatic latent image formed on the photoreceptive drum, and a gap maintenance member contacting the photoreceptive drum such that the developing roller accesses the photoreceptive drum in a non-contact state while maintaining a predetermined gap with the photoreceptive drum; and a guide portion formed on the frame to guide a movement of the at least one developing apparatus, the guide portion comprising:

an inclined portion formed on a leading portion of the guide portion to face a center shaft of the photoreceptive drum so that the gap maintenance member contacts the photoreceptive drum while pressing the photoreceptive drum in a radial direction of the photoreceptive drum.

2. The developing unit as claimed in claim 1, further comprising:

a developing roller driving mechanism driving the developing roller.

3. The developing unit as claimed in claim 2, wherein the developing roller driving mechanism comprises:

a motor;

a first gear having a first shaft rotated by the motor; and a second gear provided on a rotation shaft of the developing roller, coupled to the first gear when the gap maintenance member contacts the photoreceptive drum, having a second shaft rotated by the motor through the first and second gears, forming a first line connecting the first and second center shafts of the first and second gears, and forming a second line connecting the second center shaft of the second gear and the center shaft of the photoreceptive drum, the first line forming a gear pressure angle of an acute angle with the second line.

4. The developing unit as claimed in claim 3, wherein, when the first gear and the second gear are coupled to each other, the first center shaft of the first gear is disposed between the center shaft of the photoreceptive drum and the second center shaft of the second gear.

5. The developing unit as claimed in claim 3, wherein, when the first gear and the second gear are coupled to each other, the first center shaft of the first gear is disposed at a position opposite to the center shaft of the photoreceptive drum with respect to the second center shaft of the second gear.

6. The developing unit as claimed in claim 2, wherein the developing roller driving mechanism comprises:

a motor;

a first gear rotated by the motor and having a first center shaft; and a second gear provided on a rotation shaft of the developing roller, coupled to the first gear when the gap maintenance member contacts the photoreceptive drum, and having a second center shaft, forming a first line connecting center shafts of the first and second gears, and forming a second line connecting the second center shaft of the second gear and the center shaft of the photoreceptive drum, the first and second lines forming an angle within a range between 0° and two times of a gear pressure angle which is formed by the first and second lines so that a gear pressure formed between the first and second gears acts in a tangential direction of the photoreceptive drum.

7. The developing unit as claimed in claim 6, wherein, when the first gear and the second gear are coupled to each other, the first center shaft of the first gear is disposed between the center shaft of the photoreceptive drum and the second center shaft of the second gear.

8. The developing unit as claimed in claim 6, wherein, when the first gear and the second gear are coupled to each other, the first center shaft of the first gear is disposed at a position opposite to the center shaft of the photoreceptive drum with respect to the second center shaft of the second gear.

9. The developing unit as claimed in claim 1, wherein the at least one developing apparatus comprises:

four developing apparatuses having different colors and installed along an outer circumference of the photoreceptive drum in a multi-layer structure.

10. The developing unit as claimed in claim 1, wherein the at least one developing apparatus comprises:

a guide boss provided on a main body of the developing apparatus; and a bearing member inserted around an end portion of the rotation shaft of the developing roller and inserted in the guide portion to be slidably supported by the guide portion.

11. An electrophotographic image forming apparatus including a charger charging a photoreceptive drum having a center shaft, an exposing unit exposing the charged photoreceptive drum to form an electrostatic latent image, a developing unit developing the electrostatic latent image with toner of a predetermined color, and a transfer unit transferring the developed image to a sheet of paper, wherein the electrophotographic image forming apparatus comprises a frame; and the developing unit comprises:

at least one developing apparatus installed on the frame to access and be separated from the photoreceptive drum, and including a developing roller developing an electrostatic latent image formed on the photoreceptive drum and a gap maintenance member contacting the photoreceptive drum such that the developing roller accesses the photoreceptive drum in a non-contact state while maintaining a predetermined gap with the photoreceptive drum, and a guide portion formed on the frame to guide a movement of the at least one developing apparatus, and including an inclined portion formed on a leading portion of the guide portion to face a center shaft of the photoreceptive drum so that the gap maintenance member contacts the photoreceptive drum while pressing the photoreceptive drum in a radial direction of the photoreceptive drum.

12. The apparatus as claimed in claim 11, further comprising:

a developing roller driving mechanism driving the developing roller.

13. The apparatus as claimed in claim 12, wherein the developing roller driving mechanism comprises:

a motor;

a first gear having a first shaft rotated by the motor; and a second gear provided on a rotation shaft of the developing roller, coupled to the first gear when the gap maintenance member contacts the photoreceptive drum, having a second shaft rotated by the motor through the first and second gears, forming a first line connecting the first and second center shafts of the first and second gears, and forming a second line connecting the second center shaft of the second gear and the center shaft of the photoreceptive drum, the first line forming a gear pressure angle of an acute angle with the second line.

14. The apparatus as claimed in claim 13, wherein, when the first gear and the second gear are coupled to each other, the first center shaft of the first gear is disposed between the center shaft of the photoreceptive drum and the second center shaft of the second gear.

15. The apparatus as claimed in claim 13, wherein, when the first gear and the second gear are coupled to each other, the first center shaft of the first gear is disposed at a position opposite to the center shaft of the photoreceptive drum with respect to the second center shaft of the second gear.

16. The apparatus as claimed in claim 12, wherein the developing roller driving mechanism comprises:

a motor;

a first gear rotated by the motor and having a first center shaft; and a second gear provided on a rotation shaft of the developing roller, coupled to the first gear when the gap maintenance member contacts the photoreceptive drum, and having a second center shaft, forming a first line connecting center shafts of the first and second gears, and forming a second line connecting the second center shaft of the second gear and the center shaft of the photoreceptive drum, the first and second lines forming an angle within a range between 0° and two times of a gear pressure angle which is formed by the first and second lines so that a gear pressure formed between the first and second gears acts in a tangential direction of the photoreceptive drum.

17. The apparatus as claimed in claim 16, wherein, when the first gear and the second gear are coupled to each other, the first center shaft of the first gear is disposed between the center shaft of the photoreceptive drum and the second center shaft of the second gear.

18. The apparatus as claimed in claim 16, wherein, when the first gear and the second gear are coupled to each other, the first center shaft of the first gear is disposed at a position opposite to the center shaft of the photoreceptive drum with respect to the second center shaft of the second gear.

19. The apparatus as claimed in claim 11, wherein the at least one developing apparatus comprises:

four developing apparatuses having different colors and installed along an outer circumference of the photoreceptive drum in a multi-layer structure.

20. The apparatus as claimed in claim 11, wherein the at least one developing apparatus comprises:

a guide boss provided on a main body of the developing apparatus; and a bearing member inserted around an end portion of the rotation shaft of the developing roller and inserted in the guide portion to be slidably supported by the guide portion.

21. A developing unit of an image forming apparatus including a frame and a photoreceptive drum having a center shaft, comprising:

a plurality of developing apparatuses having a plurality of developing rollers disposed around an outer conferential surface of the photoreceptive drum to develop respective electrostatic latent images formed on the photoreceptive drum with developing agents, respectively; and a plurality of guide portions guiding corresponding ones of the developing rollers to move toward the photoreceptive drum in a plurality of radial directions of the photoreceptive drum, respectively.

22. The developing unit as claimed in claim 21, wherein the guide portions comprise:

a plurality of linear portions guiding corresponding ones of the developing rollers to move toward the photoreceptive drum in the same direction, respectively; and a plurality of inclined portions having a plurality of angles with respect to the same direction to guide corresponding ones of the developing rollers to move toward the photoreceptive drum in corresponding ones of the radial directions of the photoreceptive drum, respectively.

23. The developing unit as claimed in claim 22, wherein each of the developing apparatuses comprises:

a guide boss moving along a corresponding one of the linear portions; and a member rotatably formed on a corresponding one of the developing rollers to move along a corresponding one of the linear portions and a corresponding one of the inclined portions.

24. The developing unit as claimed in claim 21, further comprising:

a rotation source;

a plurality of driving gears each having a first shaft coupled to the rotation source and rotating by the rotation source; and a plurality of driven gears each having a second shaft coupled to a corresponding one of the developing rollers and rotating by a corresponding one of the driving gears, respectively.

25. The developing unit as claimed in claim 24, wherein the second shaft of each of the driven gears forms a first line with a center shaft of the photoreceptive drum and a second line with the second shaft of a corresponding one of the driven gears, and the first line is not parallel to the second line.

26. The developing unit as claimed in claim 25, wherein the first line forms an acute angle with the second line.

27. The developing unit as claimed in claim 21, wherein each of the guide portions comprises:

a surface parallel to a corresponding one of the radial directions.

28. The developing unit as claimed in claim 21, wherein each of the guide portions comprises:

a linear portion guiding a corresponding one of the developing rollers to move toward the photoreceptive drum in the same direction; and a surface extended from the linear portion to push a corresponding one of the developing roller from the same direction to a corresponding one of the radial directions.

29. A developing unit of an image forming apparatus including a frame and a photoreceptive drum having a center shaft, comprising:

first, second, third, and fourth developing apparatuses, respectively, having first, second, third, and fourth developing rollers disposed around an outer conferential surface of the photoreceptive drum to develop respective electrostatic latent images formed on the photoreceptive drum with developing agents, respectively; and first, second, third and fourth guide portions, respectively, guiding the first, second, third, and fourth developing rollers to move toward the photoreceptive drum in first, second, third, and fourth radial directions of the photoreceptive drum, respectively.

30. The developing unit as claimed in claim 29, wherein the first, second, third, and fourth radial directions are not the same.

31. The developing unit as claimed in claim 29, wherein the first, second, third and fourth guide portions comprise:

first, second, third, and fourth linear portions guiding the first, second, third, and fourth developing rollers to move toward the photoreceptive drum in the same direction, respectively; and first, second, third, and fourth inclined portions having first, second, third, and fourth angles with respect to the same direction to guide the first, second, third, and fourth developing rollers to move toward the photoreceptive drum in corresponding ones of the radial directions of the photoreceptive drum, respectively.

32. The developing unit as claimed in claim 31, wherein the first, second, third and fourth inclined angles are not the same.

33. The developing unit as claimed in claim 31, wherein the first and fourth inclined angles are the same, and the second and third inclined angles are the same.

34. The developing unit as claimed in claim 31, wherein the first, second, third, and fourth inclined angles are one of two different angles.

35. The developing unit as claimed in claim 31, wherein each of the first, second, third, and fourth developing apparatuses comprises:

a guide boss moving along a corresponding one of the first, second, third, and fourth linear portions; and a member rotatably formed on a corresponding one of the first, second, third, and fourth rollers to move along a corresponding one of the first, second, third, and fourth linear portions and a corresponding one of the first, second, third, and fourth inclined portions.

36. The developing unit as claimed in claim 35, further comprising:

a door rotatably coupled to the frame to open and close the developing unit disposed in the frame; and first, second, third, and fourth elastic members coupled between the door and corresponding ones of the first, second, third, and fourth developing apparatuses, respectively.

37. The developing unit as claimed in claim 36, wherein the member of each of the first, second, third, and fourth developing apparatuses moves along the corresponding one of the first, second, third, and fourth inclined portions when the door is closed and opened.

38. The developing unit as claimed in claim 31, further comprising:

a rotation source;

first, second, third, and fourth driving gears each having a first shaft coupled to the rotation source and rotating by the rotation source; and first, second, third, and fourth driven gears each having a second shaft coupled to a corresponding one of the first, second, third, and fourth developing rollers and rotating by a corresponding one of the first, second, third, and fourth driving gears, respectively.

39. The developing unit as claimed in claim 38, wherein the second shaft of each of the first, second, third, and fourth driven gears forms a first line with a center shaft of the photoreceptive drum and a second line with the second shaft of each of the first, second, third, and fourth driven gears, and the first line is not parallel to the second line.

40. The developing unit as claimed in claim 38, wherein the first line forms an acute angle with the second line.

41. The developing unit as claimed in claim 38, wherein the second shaft is disposed between the first shaft and the center shaft of the photoreceptive drum.

42. The developing unit as claimed in claim 38, wherein the first shaft is disposed between the second shaft and the center shaft of the photoreceptive drum.

43. The developing unit as claimed in claim 38, wherein the photoreceptive drum has a radius, and a distance between the second shaft and the center shaft of the photoreceptive drum is shorter than the radius.

44. The developing unit as claimed in claim 38, wherein the photoreceptive drum rotates in a first rotation direction, and the second shaft is disposed in a direction opposite to the first direction with respect to the first line.

45. A developing unit of an image forming apparatus including a frame, a developing unit main body, and a developing roller having a rotation shaft comprising:

a guide portion formed on the frame;

a guide boss formed on the developing unit main body and slidably inserted into the guide portion; and a bearing member rotatably supporting the rotation shaft of the developing roller and rotatably inserted into the guide portion.

46. A developing unit of an image forming apparatus including a frame, a developing unit main body movably disposed on the frame, a developing roller having a rotation shaft, and a photoreceptive drum, comprising:

a motor;

a first gear coupled to the motor; and a second gear formed on one end of the rotation shaft of the developing roller, and disposed to contact the first gear selectively according to a movement of the developing unit main body.

* * * * *